US005605584A

United States Patent [19]

DeLuca et al.

[11] Patent Number: 5,605,584

[45] Date of Patent: Feb. 25, 1997

[54] DAMAGE TOLERANT ANISOTROPIC NICKEL BASE SUPERALLOY ARTICLES

[75] Inventors: Daniel P. DeLuca, Tequesta; Howard B. Jones; Bradford A. Cowles, both of Palm Beach Gardens, all of Fla.

[73] Assignee: United Technologies Corporation, Hartford, Conn.

[21] Appl. No.: 380,231

[22] Filed: Jan. 30, 1995

Related U.S. Application Data

[63] Continuation of Ser. No. 140,345, Oct. 20, 1993, abandoned.

[51] Int. Cl.[6] ..... C22C 19/05

[52] U.S. Cl. ..... 148/410; 148/409

[58] Field of Search ..... 148/409, 410

[56] References Cited

U.S. PATENT DOCUMENTS

| | | | |
|---|---|---|---|
| 4,093,476 | 6/1978 | Boesch | 148/410 |
| 4,402,772 | 9/1983 | Duhl et al. | 148/404 |
| 4,643,782 | 2/1987 | Harris et al. | 148/404 |
| 4,677,035 | 6/1987 | Fiedler et al. | 428/680 |
| 4,802,934 | 2/1989 | Ohno et al. | 148/404 |
| 4,885,216 | 12/1989 | Naik | 428/680 |
| 4,888,069 | 12/1989 | Duhl et al. | 148/410 |
| 4,908,183 | 3/1990 | Chin et al. | 148/410 |
| 5,059,257 | 10/1991 | Wanner et al. | 148/410 |
| 5,077,141 | 12/1991 | Naik et al. | 428/680 |
| 5,100,484 | 3/1992 | Wukusick et al. | 148/675 |
| 5,143,563 | 9/1992 | Krueger et al. | 148/410 |
| 5,154,884 | 10/1992 | Wukusick et al. | 420/448 |

*Primary Examiner*—David A. Simmons
*Assistant Examiner*—Margery S. Phipps

[57] ABSTRACT

Columnar grain and single crystal nickel base superalloys are heat treated to provide a damage tolerant microstructure. The microstructure contains large, irregularly shaped "barrier" γ' particles interspersed in an ordered array of smaller cuboidal γ' particles in a γ phase matrix. The barrier particles interrupt the progression of cracks through the microstructure. The invention process includes solutioning the γ' phase, cooling slowly to a temperature about 50° F. to 150° F. (28° C. to 83° C.) below the γ' solvus temperature, further cooling at a rate of at least about 100° F. (56° C.) per minute to less than 1000° F. (538° C.), reheating to 1975° F. to 2000° F. (1079° C. to 1093° C.) and holding for about four to six hours, cooling at 100° F. (56° C.) per minute to less than 1000° F. (538° C.), and heating to 1600° F. ±25° F. (871° C. ±14° C.) and holding for 24 hours to 32 hours.

6 Claims, 2 Drawing Sheets fig. 1A
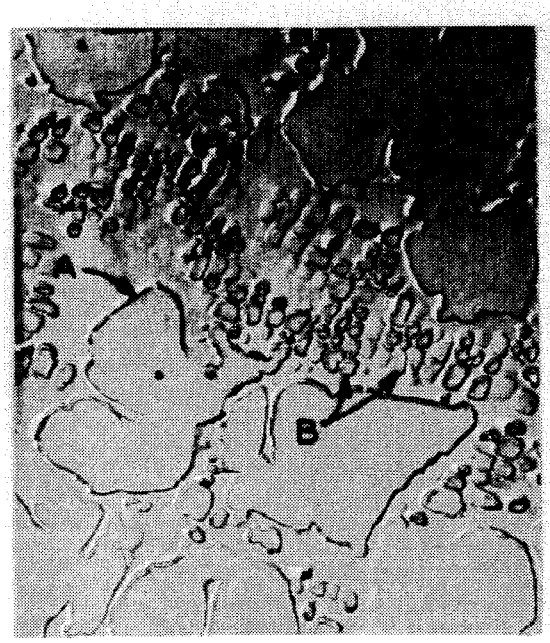
fig. 1B
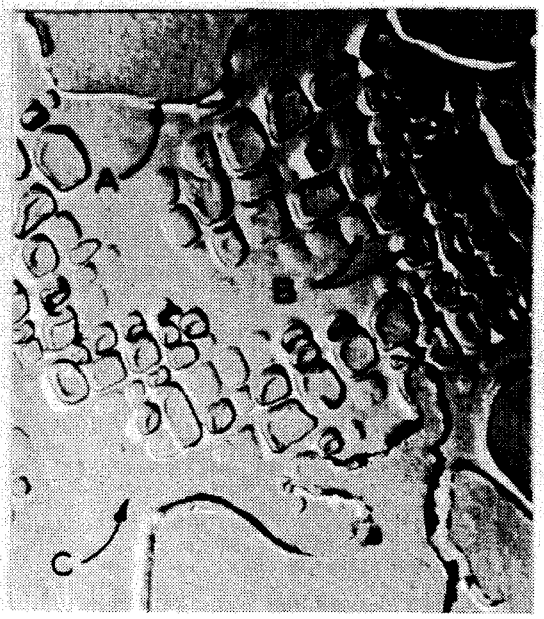
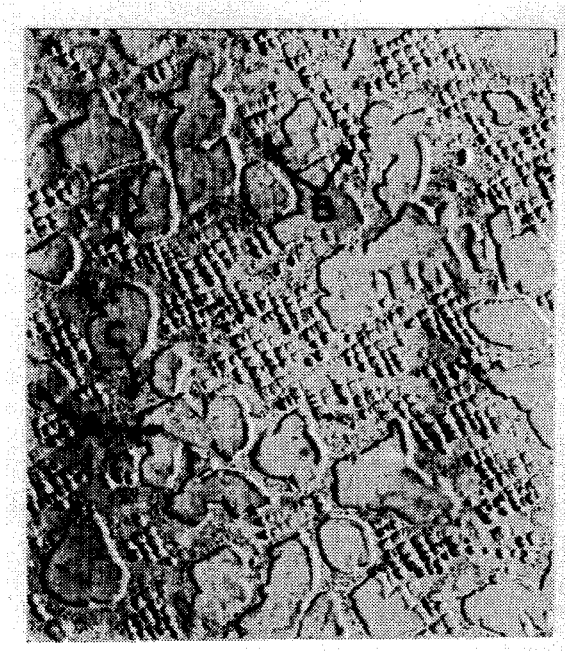
fig. 3A
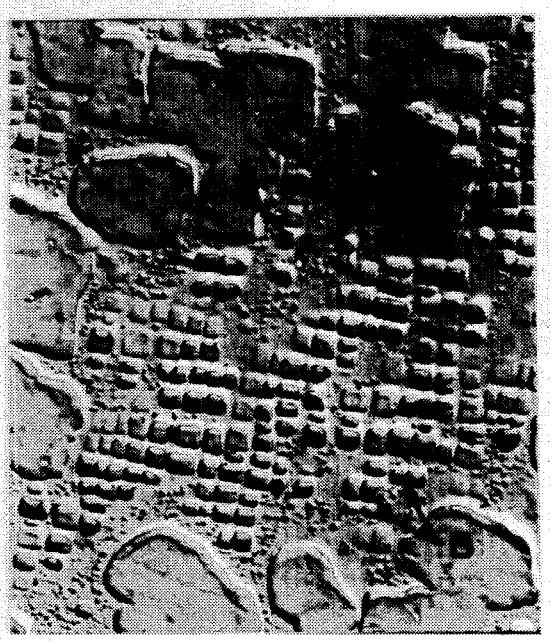
fig. 3B

DAMAGE TOLERANT ANISOTROPIC NICKEL BASE SUPERALLOY ARTICLES

This is a continuation of application Ser. No. 140,345, filed on Oct. 20, 1993, now abandoned.

TECHNICAL FIELD

The present invention relates to anisotropic (i.e., single crystal and columnar grain) nickel base superalloy articles having damage tolerant microstructure, and to a method for producing articles with the damage tolerant microstructure.

BACKGROUND ART

Nickel base superalloys have been extensively developed for use in gas turbine engines, mainly because of their superior high temperature mechanical properties. As engineers have increased the operating temperatures of these engines to increase the power output and efficiency, the need for materials which will withstand the higher temperatures has been of prime concern.

Significant improvements in alloy chemistry, processing and microstructure have been made, in order to meet these increased requirements. The development of columnar grain and single crystal materials has contributed even further to the elevated temperature capability of the materials.

The usefulness of columnar grain and single crystal materials is based on the principle that the greatest strength of the material is associated with particular crystallographic orientations. The successful use of these materials depends on aligning the preferred crystallographic orientation of the material to the maximum stress axis of the component being made. While the presence of grain boundaries in the columnar grain articles is less than ideal, the orientation of the grains with the (001) direction parallel to the grain boundaries takes advantage of the superior strength and creep resistance in this orientation. The absence of transverse grain boundaries avoids the detriment associated with having the weak grain boundaries aligned in the plane of highest stress, i.e., perpendicular to the loading direction. In this manner the optimum use of the material capabilities is made.

There are many applications where the unique properties of single crystal and columnar grain alloys are beneficial. A very useful application has been found in gas turbine engine components, where the anisotropic materials have permitted significant increases in operating temperature and efficiency. For example, both blades and vanes in the turbine section utilize anisotropic single crystal and columnar grain alloys.

The microstructure of PWA 1480, a nickel base single crystal superalloy material having a nominal composition of 10 Cr, 5 Co, 4 W, 1.5 Ti, 12 Ta, 5 Al, balance nickel, with all quantities in weight percent, consists of generally uniformly cubic shaped γ' precipitate particles (approximately 60% by volume) in a continuous γ matrix. The precipitate particles range in size from about 0.35 μ to about 0.50 μ and form an ordered array of face centered cubic (FCC) particles based on $Ni_3Al(Ti)$. Cube edges of the precipitate particles are aligned with the <001 > family of crystallographic directions. This microstructure is common to γ' strengthened nickel base columnar grain and single crystal turbine component alloys.

The high temperature (1600° F., or 870° C., and above) property requirements are dictated by the environment in which the airfoil portion of a gas turbine blade must operate. Historically the primary consideration in turbine blade alloy development has been to achieve high temperature strength, creep capability, and oxidation and erosion resistance.

Significant advancements have been made in meeting these needs by the development of optimum alloy chemistry, microstructure and casting form (i.e., equiaxed, columnar grain, single crystal). Microstructural parameters for γ' particle size, shape, volume fraction and γ—γ' misfit have evolved to where they are today to achieve an optimum balance between high temperature strength and resistance to creep. The optimization of the universally employed fine, uniform cuboidal γ' precipitate particle structure has been fundamental in meeting this end.

U.S. Pat. Nos. 4,402,772, 4,643,782, 4,677,035, 4,802,934, 4,885,216, 5,077,141, 5,100,484 and 5,154,884 all disclose the formation of very small γ' particles in order to obtain the optimum combination of mechanical properties in single crystal superalloy materials. The small particle size is obtained in prior art processing by cooling the material from the solutionizing temperature at a rapid rate, generally at least 100° F. (56° C.) per minute, followed by aging.

The attachment area, or root, of a turbine blade operates at a lower temperature than the airfoil portion, and presents a different set of operational requirements. Current trends in gas turbine technology emphasize damage tolerance (i.e., resistance to crack propagation) for the attachment areas. Microstructural parameters developed for high temperature capability required in the airfoils are not necessarily optimum for the crack growth resistance required in the attachment area.

We have investigated the micromechanics of fracture in the γ' strengthened anisotropic superalloys and have observed fatigue crack growth to be highly dependent on γ' precipitate morphology.

We have observed that, from about 800° F. (427° C.), the minimum stress intensity necessary to propagate a crack increases with increasing temperature up to about 1600° F. (871° C.). This is consistent with the tendency for γ strengthened superalloys to exhibit an increase in the critical resolved shear stress (CRSS), and consequently yield strength, with increasing temperature. This behavior demonstrates that γ' deformation mechanisms affect fracture.

The microscopic failure mode under these conditions indicates that the prior art precipitate morphology responds to fatigue crack growth as a homogeneous isotropic solid, resulting in a singular microscopic fracture mode. This mode is characterized as trans-precipitate non-crystallographic fracture. Our experience has shown that a mixed mode fracture propagates more slowly.

Damage tolerance also becomes a critical requirement when anisotropic γ' strengthened superalloys are used in hydrogen fueled rocket engines. The critical operating condition for a rocket turbine component is where maximum stresses occur at relatively low temperature in a high pressure gaseous hydrogen environment.

Post-test fractographic analysis of failed specimens reveals differences in the operative microscopic fatigue crack growth fracture modes observed in air and hydrogen. Fractures produced in air exhibit crystallographic crack propagation predominantly on microscopic (111) octahedral planes. Fractures produced in hydrogen exhibit preferential fatigue crack propagation in the γ phase region of the microstructure in the vicinity of the γ—γ' interface, essentially parallel to the (001) crystallographic planes. Fatigue crack growth under these conditions is greatly accelerated. FIG. 2 illustrates the effect of 5000 psi (34.5 MPa) hydrogen on the fatigue crack growth rate of PWA 1480 having the prior art microstructure (ordered array of fine, cuboidal γ' particles). The crack growth rate is approximately ten to 100 times greater in hydrogen than in air.

Columnar grain and single crystal materials as applied to gas turbine engines use are similar in nature in that the crystallographic orientation of the material is essentially the same. Even though the columnar grain materials have grain boundaries, which are generally associated with a weaker material, the orientation of the grain boundaries is generally parallel within about 15° of the direction of applied load, and the grain boundaries consequently do not present an interface which is significantly stressed by centrifugal loading. Thus the key microstructural features that affect hydrogen fatigue crack propagation are common to both single crystal and columnar alloys, i.e., a geometrically ordered cuboidal γ' precipitate array with cube edges oriented coincident with the (001) crystallographic directions. This configuration positions planar fields of the weaker γ phase coincident with the plane of crack propagation in an (001) loaded system.

What is needed are single crystal and columnar grain materials having improved resistance to crack growth (damage tolerance) in hydrogen fueled or conventional gas turbine engines.

What is also needed is a process for creating the damage tolerant single crystal and columnar grain materials.

DISCLOSURE OF INVENTION

The damage tolerant material of the present invention comprises a multiple γ' particle size and a γ' particle morphology comprising large, irregularly shaped γ' particles, ranging from about 5 to about 15 microns in size, interspersed in an ordered array of cuboidal γ' particles, having a size range of about 0.3 to about 0.7 microns, along with superfine, generally spheroidal, γ' particles having a size on the order of about 0.01 microns, all in a γ phase matrix. Typically there is up to about 50% by volume of the large γ' particles and up to about 60% by volume of the cuboidal γ' particles, with the preferred amounts being about 15% to 50% by volume of the large γ' particles and 10% to 45% by volume of the cuboidal γ' particles, and the most preferred amounts being about 30% to 40% by volume of the large γ' particles and 15% to 30% by volume of the cuboidal γ' particles. The large γ' particles generally have branched configurations, with three or four branches being typical.

This microstructure has been shown to be effective in restraining the progression of an advancing crack front by eliminating the uninterrupted layers of γ phase available for crack progression in the prior art array of uniform cuboidal γ' particles.

This invention is applicable to single crystal nickel base superalloys, and to columnar grain nickel base superalloys where the (001)crystallographic orientation of the grains is within about 15° of the direction of the applied load.

The modified microstructure affects dislocation dynamics in a manner which produces a mixed crystallographic-noncrystallographic failure mode. This greatly improves elevated temperature crack growth rates by producing a more tortuous crack path than the single mode fracture produced by the prior art microstructure.

The process of this invention which successfully provides the novel microstructure comprises solutioning the material at a temperature above the γ' solvus temperature and below the incipient melting temperature for a time sufficient to dissolve the γ' phase, slow cooling at a rate of approximately 0.1° F. to 15.0° F. (0.06° C. to 8.30° C.) per minute from the solution temperature to a temperature about 50° F. to 150° F. (28° C. to 83° C.) below the γ' solvus temperature to grow large "barrier" γ' particles, further cooling at a rate of at least 100° F. (56° C.) per minute minimum to less than 1000° F. (538° C.), reheating to 1975° F. to 2000° F. (1079° C. to 1093° C.) and holding for about four to six hours to precipitate and stabilize the cuboidal γ' particles, cooling at 100° F. (56° C.) per minute or faster to less than 1000° F. (538° C.), heating to 1600° F. ±25° F. (871° C. ±14° C.) and holding for 24 hours to 32 hours to precipitate superfine cuboidal γ' particles. The slow cooling rate from the solution temperature is preferably about 0.1° F. to 8.0° F. (0.06° C. to 4.40° C.) per minute, and most preferably about 0.3° F. to 3.0° F. (0.2° C. to 1.7° C.) per minute.

The detrimental effects of hydrogen on the microscopic failure mode are reduced with a modified γ' precipitate morphology. The crack growth behavior of PWA 1480 with the prior art microstructure is shown in comparison to the new invention microstructure in FIG. 2, which shows that the crack growth rate of the conventionally processed material is approximately five to seven times that of the material processed according to the present invention when both are tested in a hydrogen atmosphere.

With this invention, fatigue crack growth capability is greatly improved under hydrogen embrittlement conditions and also under conditions where hydrogen embrittlement is not a consideration.

These, and other features and advantages of the invention, will be apparent from the description of the Best Mode, read in conjunction with the figures.

BRIEF DESCRIPTION OF DRAWINGS

FIG. 1A is a photomicrograph at 4600X showing the microstructure of single crystal PWA 1480 processed according to this invention.

FIG. 1B is a photomicrograph at 10,000X showing the microstructure of single crystal PWA 1480 processed according to this invention.

FIG. 3A is a photomicrograph at 4600X showing the microstructure of columnar grain PWA 1422 processed according to this invention.

FIG. 3B is a photomicrograph at 10,000X showing the microstructure of columnar grain PWA 1422 processed according to this invention.

BEST MODE FOR CARRYING OUT THE INVENTION

Figure 2:
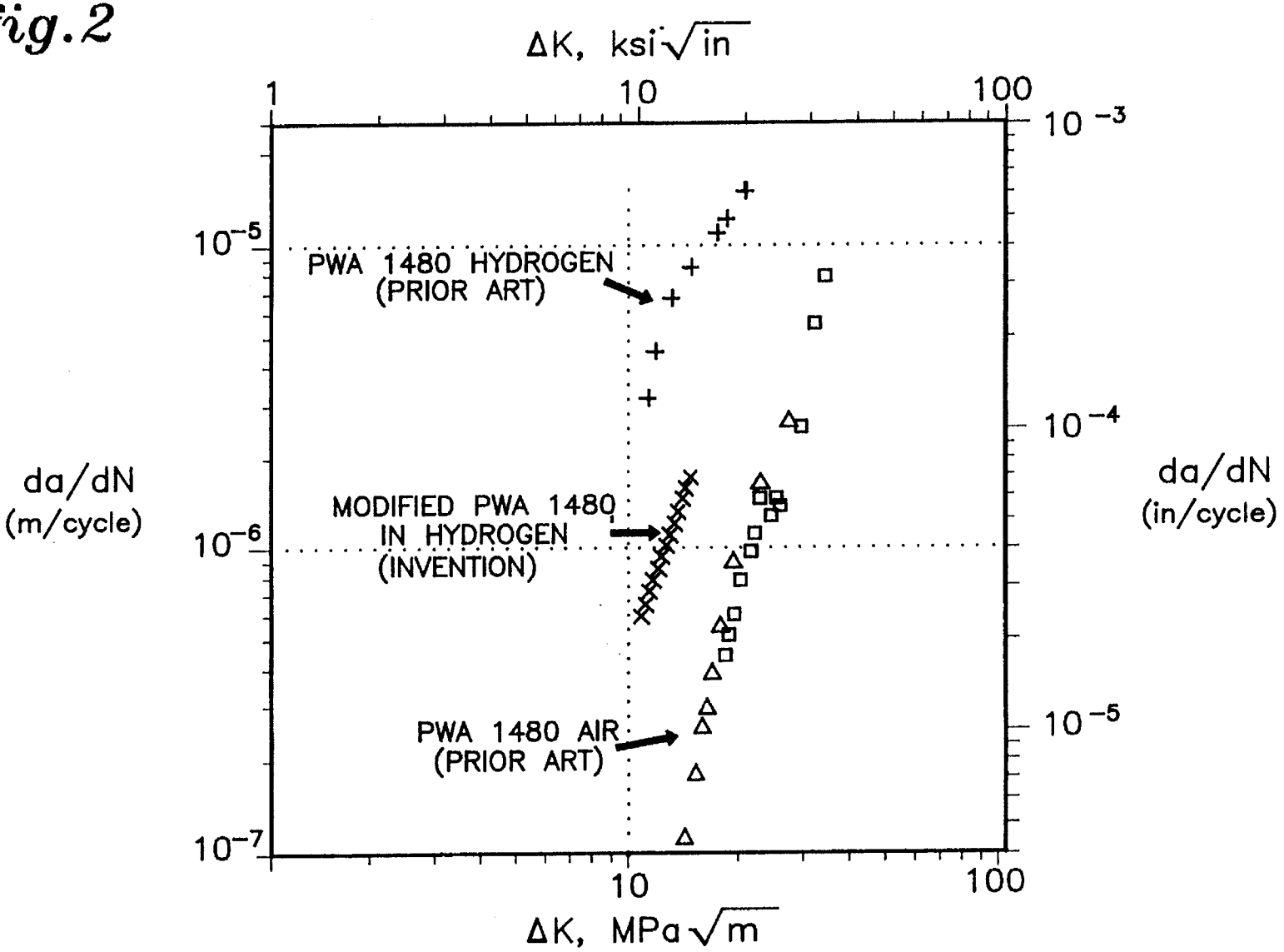
FIG. 2 is a graph comparing the crack growth rates in air and hydrogen of conventionally processed PWA 1480 with the crack growth rate in hydrogen of PWA 1480 processed according to the present invention as tested.

The damage tolerant material of the present invention can be produced by heat treating a single crystal or columnar grain nickel base superalloy so as to produce two or more distinct size groups of γ' particles in a γ matrix. The most significant size groups include large particles of about 5 microns to 15 microns, and small particles of about 0.2 microns to 0.7 microns. In this bimodal material, a growing crack can progress only a limited distance through a region of an ordered array of small, uniformly cuboidal γ' particles before it encounters a much larger barrier particle which effectively blocks its progress. To grow further, the crack must then find an alternate path around the large particle, which is much more difficult than merely continuing along the same path.

While the heat treatment procedure used in the examples in this patent application commonly produces a trimodal material having three distinct particle size ranges, we believe that a bimodal material which contains only two particle sizes, the large and the small, would be equally effective in rendering the material damage tolerant. While the presence of the third, superfine, size range of particles, on the order of 0.1 microns in size, may contribute somewhat to the crack growth resistance of the material, based on the same theory as that for the two larger particle size ranges, it is also possible that the superfine particles contribute little to the damage tolerant properties of the material.

The process of the present invention may be better understood through reference to the following illustrative examples.

EXAMPLE I

A test bar blank of single crystal PWA 1480 was heated to 2300° F. (1258° C.) and held for 30 minutes, heated to 2340° F. (1282° C.) at 1° F. (0.6° C.) per minute, heated to 2350° F. (1288° C.) at 0.17° F. (0.1° C.) per minute, held at 2350° F. (1288° C.) for two hours, heated to 2360° F. (1293° C.) at 0.33° F. (0.18° C.) per minute and held for 30 minutes, cooled to 2250° F. (1232° C.) at about 0.5° F. (0.3° C.) per minute, cooled to below 1000° F. (538° C.) at about 115° F. (64° C.) per minute, cooled to room temperature, heated to 1975° F. (1079° C.) and held for six hours, air cooled to room temperature, heated to 1600° F. (871° C.) and held for 32 hours, and air cooled to room temperature.

Metallographic examination of the blank showed a triplex γ particle size morphology, as shown in FIGS. 1A at 4600X and 1B at 10,000X, with the large γ' particles ranging from about 5 microns to about 15 microns in size, the small γ' particles ranging from about 0.3 microns to about 0.7 microns, and the superfine spheroidal γ' particles on the order of 0.01 microns. The coarse barrier γ', fine cuboidal γ' and superfine spheroidal γ' particles are indicated by the arrows A, B and C, respectively.

Fatigue crack growth test specimens were machined and tested to permit measurement of fatigue crack growth rates in an atmosphere of hydrogen at room temperature and 5000 psi (34.5 MPa). The results are summarized in FIG. 2, which shows that the crack growth rate of the conventionally processed PWA 1480 material in hydrogen is about thirty to eighty times greater than that in air. The crack growth rate of the conventionally processed PWA 1480 in hydrogen is about five to seven times that of invention processed PWA 1480 in hydrogen.

EXAMPLE II

A test bar blank of columnar grain PWA 1422, a nickel base columnar grain superalloy material having a nominal composition of 9 Cr, 10.1 Co, 12.0 W, 2.0 Ti, 5.0 Al, 0.015 B, 1.0 Cb, 2.0 Hf, 0.14 C, balance Ni, with all quantities in weight percent, was heated to 2225° F. (1218° C.) and held for ten minutes, heated to 2250° F. (1232° C.) at 0.5° F. (0.3° C.) per minute and held for 45 minutes, cooled to 2140° F. (1171° C.) at 0.5° F. (0.3° C.) per minute, air cooled to room temperature, heated to 1975° F. (1079° C.) and held for four hours, air cooled to room temperature, heated to 1600° F. (871° C.) and held for 24 hours, and air cooled to room temperature.

Metallographic examination of the blank showed a triplex γ' particle size morphology, as shown in FIGS. 3A at 4600X and 3B at 10,000X, with the large γ' particles ranging from about 5 microns to about 15 microns in size, the small γ' particles ranging from about 0.2 microns to about 0.4 microns, and the superfine γ' particles on the order of 0.01 microns. The coarse barrier γ', fine cuboidal γ' and superfine γ' are indicated by the arrows A, B and C, respectively.

Those skilled in the art will understand that the γ' precipitate morphology produced and tested with the single crystal alloy PWA 1480 will respond in a similar manner in the columnar grain PWA 1422 alloy, since the microscopic modes of failure are common to both alloy types.

Although this invention has been shown and described with respect to detailed embodiments thereof, it will be understood by those skilled in the art that various changes, omissions and additions in form and detail thereof may be made without departing from the spirit and scope of the claimed invention.

We claim:

1. A nickel base superalloy material having a composition selected from the group consisting of about 10% Cr, 5% Co, 4% W, 1.5%. Ti, 12% Ta, 5% Al, Bal essentially Ni and about 9% Cr, 10.1%.Co, 12% W, 2% Ti, 5% Al, 0.015% B, 1Cb, 2Hf, 0.14% C, Bal essentially Ni, with a microstructure selected from the group consisting of single crystal and columnar grain and having a multiple particle size γ' precipitate in a γ phase matrix comprising:

a. large irregularly shaped barrier γ' particles ranging from about five to about 15 microns in size;

b. an array of cuboidal γ' particles ranging from about 0.2 microns to about 0.7 microns in size; and c. a γ phase continuous matrix, wherein the multiple size γ' precipitates provide improved resistance to crack propagation.

2. The material as recited in claim 1 further containing superfine spheroidal γ' particles on the order of 0.01 microns in size.

3. The material of claim 1, wherein said material has a columnar grain microstructure, so that when the crystallographic orientation of said columnar grain microstructure is such that the 100 crystallographic orientation of said columnar grain is within about 15° of the direction of a principal load, the material is capable of displaying enhanced creep and strength properties in the direction of the principal load.

4. The material as recited in claim 1 wherein the amount of barrier γ' particles is up to about 50% by volume and the amount of cuboidal γ' particles is up to about 60% by volume.

5. The material as recited in claim 1 wherein the amount of barrier γ' particles is about 15% to 50% by volume and the amount of cuboidal γ' particles is about 10% to 45% by volume.

6. The material as recited in claim 1 wherein the amount of barrier γ' particles is about 30% to 40% by volume and the amount of cuboidal γ' particles is about 15% to 30% by volume.

* * * * *